US005830281A

United States Patent [19]

Kliewer et al.

[11] Patent Number: 5,830,281

[45] Date of Patent: Nov. 3, 1998

[54] METHOD FOR CONTROLLING AND CONTAINING A LIQUID ON A HARD SURFACE

[75] Inventors: Phillip A. Kliewer; Jeffrey J. Smith, both of Lancaster, Pa.

[73] Assignee: R.R. Donnelley & Sons Company, Chicago, Ill.

[21] Appl. No.: 734,389

[22] Filed: Oct. 17, 1996

Related U.S. Application Data

[63] Continuation of Ser. No. 397,415, Apr. 17, 1995, abandoned, which is a continuation of Ser. No. 192,194, Feb. 4, 1994, abandoned, which is a continuation of Ser. No. 900,318, Jun. 18, 1992, abandoned.

[51] Int. Cl.[6] ..... B08B 7/00; B01D 15/00

[52] U.S. Cl. ..... 134/6; 15/209.1; 15/210.1; 15/228; 15/244.3; 15/222; 210/242.4; 210/484; 210/924

[58] Field of Search ..... 136/6; 15/209.1, 15/210.1, 228, 244.3, 222; 210/242.4, 484, 924

[56] References Cited

U.S. PATENT DOCUMENTS 4,366,067 12/1982 Golding et al. ..... 210/671
4,537,877 8/1985 Ericsson ..... 210/693

*Primary Examiner*—Zeinab El-Arini
*Attorney, Agent, or Firm*—Marshall, O'Toole, Gerstein, Murray & Borun

[57] ABSTRACT

A method for using a heretofore industrial waste material for the utilitarian purpose of controlling and containing a liquid on a hard surface. The method includes the steps of accumulating an industrial waste material in the form of paper dust in a bindery for use as a loose filler for a container, forming a container from a fabric having a porosity sufficient for passage of the liquid therethrough, substantially entirely filling the container with the paper dust as accumulated at the bindery, and thereafter closing the container after it has been substantially filled with the accumulated paper dust from the bindery. Additionally, the method includes placing the container on the surface after closing in order to control and contain the liquid on the hard surface thereby.

6 Claims, 2 Drawing Sheets

METHOD FOR CONTROLLING AND CONTAINING A LIQUID ON A HARD SURFACE

This is a Rule 62 continuation of U.S. application Ser. No. 08/397,415, filed Apr. 17, 1995, now abandoned, which in turn is a Rule 60 continuation of U.S. application Ser. No. 0/192,194, filed Feb. 4, 1994, now abandoned, which in turn is a Rule 62 continuation of U.S. application Ser. No. 07/900,318, filed Jun. 18, 1992, now abandoned.

BACKGROUND OF THE INVENTION

The present invention is generally directed to liquid spillage and, more particularly, an apparatus for controlling and containing a liquid on a surface.

In recent years, there has been a growing recognition of the considerable importance of environmental control. This runs the gamut from controlling any of a vast variety of unwanted liquid spills such as, for example, leakage and spillage of oil and other fluid and solvents around machinery to oil spills on waterways and land masses. As is recognized, environmental control has steadily become an important factor in the economic survival of many industrial enterprises.

Over the years, a variety of expedients have been used in attempt to solve such problems. For instance, various inorganic, natural organic, and synthetic materials have been tried for controlling oil spills, in addition to the use of detergents and emulsifying agents suitable for dispersing oil in solution with water and polymeric foams and liquids which absorb oil. In some instances, such materials have proven effective for a specific application in a particular industry.

In addition to the foregoing, there has also been a growing recognition of the considerable difficulties in industrial waste disposal. The nation's landfills are rapidly being filled to capacity making it essentially mandatory to encourage recycling and reuse of available materials to the fullest extent possible. As a result, there is an ever increasing need to discover a function for even the most common waste materials.

In a bindery, the problem of spillage of liquids is known to exist. This can typically include oil spills around industrial machinery which must be suitably controlled, contained, and/or absorbed in order to prevent contamination of the work place and possible health or injury hazards to personnel. Still additionally, a bindery is known to produce a vast amount of waste in the form of paper dust.

Those skilled in the art have heretofore labored with both of these problems with varying degrees of success and, thus, the present invention is directed to overcoming one or more of the foregoing problems and achieving one or more of the resulting objects.

SUMMARY OF THE INVENTION

It is a principal object of the present invention to provide an apparatus for controlling and containing a liquid on a surface. It is a further object of the present invention to provide such an apparatus suitable for absorbing and retaining a spillage of oil on a concrete floor in a bindery or the like. It is an additional object of the present invention to provide a method for controlling and containing a liquid on a surface.

Accordingly, the present invention is directed to an apparatus for controlling and containing a liquid on a surface. A fabric container is provided which has a porosity sufficient to accommodate passage of the liquid therethrough and a filler material is disposed in the fabric container for at least partially absorbing the liquid therewithin. With this arrangement, the filler material for partially absorbing the liquid within the fabric container includes a paper dust.

In one embodiment, the fabric container is formed into a closed flexible tube. Advantageously, the fabric container is formed of a liquid absorbing cloth. Alternatively, the fabric container may be formed into a closed flexible bag.

In the exemplary embodiment, the apparatus is adapted to absorb and retain a spillage of a liquid on a hard surface. It will be appreciated that the closed fabric container, whether a flexible tube or flexible bag, is advantageously formed of a cloth material for at least partially absorbing the liquid therewithin. Advantageously, the filler material comprises a loose bindery paper dust substantially entirely filling the closed fabric container.

With this arrangement, the closed fabric container preferably has a porosity sufficient to prevent passage of the loose bindery paper dust therethrough and the liquid may be oil with the hard surface comprising a concrete floor in a bindery or the like.

In another respect, the present invention will be understood to be directed to a method for controlling and containing a liquid such as oil on a surface such as a concrete floor. The method comprises the steps of forming a container from a fabric having a porosity sufficient to accommodate the passage of the liquid therethrough, filling the container with a material including a paper dust for at least partially absorbing the liquid therewithin, and closing the container after filling the container with the material in a manner to confine the material therewithin. With this understanding, the method will also include the step of placing the container on the surface after closing the container in order to control and contain the liquid thereby.

In one form, the method includes the step of forming the container into a closed flexible tube and thereafter placing the closed flexible tube about the liquid on the hard surface. In another form, the method includes the step of forming the container into a plurality of closed flexible bags and thereafter placing the bags about the liquid on the hard surface.

Other objects, advantages, and features of the present invention will become apparent from a consideration of the following specification taken in conjunction with the accompanying drawings.

DETAILED DESCRIPTION OF THE PREFERRED EMBODIMENT

Figure 1:
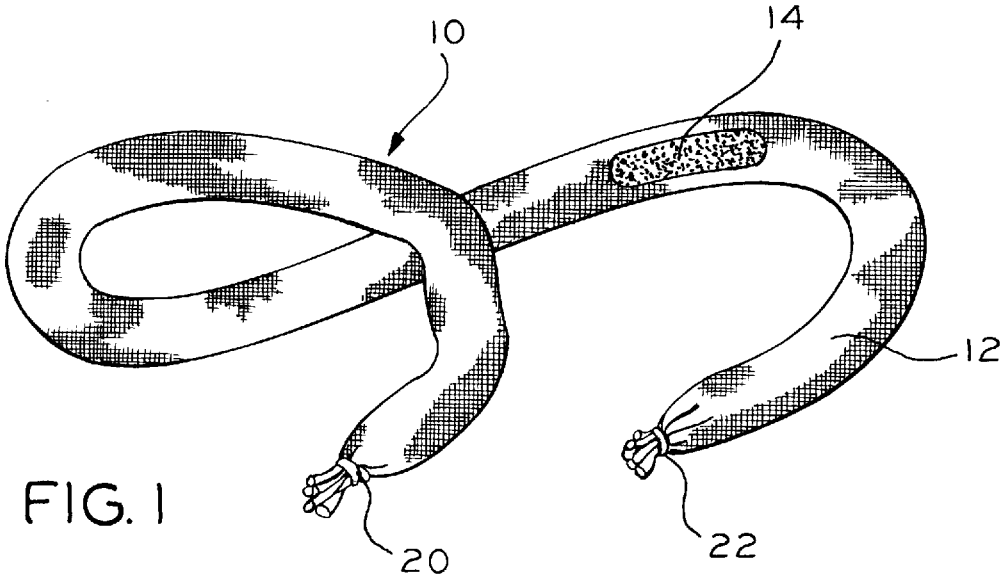
FIG. 1 is a perspective view of an apparatus for controlling and containing a liquid in accordance with the present invention.

In the illustrations given, and referring first to FIG. 1, the reference numeral 10 designates generally an apparatus for controlling and containing a liquid in accordance with the present invention. The apparatus 10 includes a fabric container 12 having a porosity sufficient to accommodate passage of the liquid therethrough and a filler material 14 in the fabric container 12 for at least partially absorbing the liquid therewithin. In the illustrated embodiment, the filler material 14, which is particularly well suited for partially absorbing the liquid within the fabric container 12, will be understood to comprise a paper dust.

Figure 2:
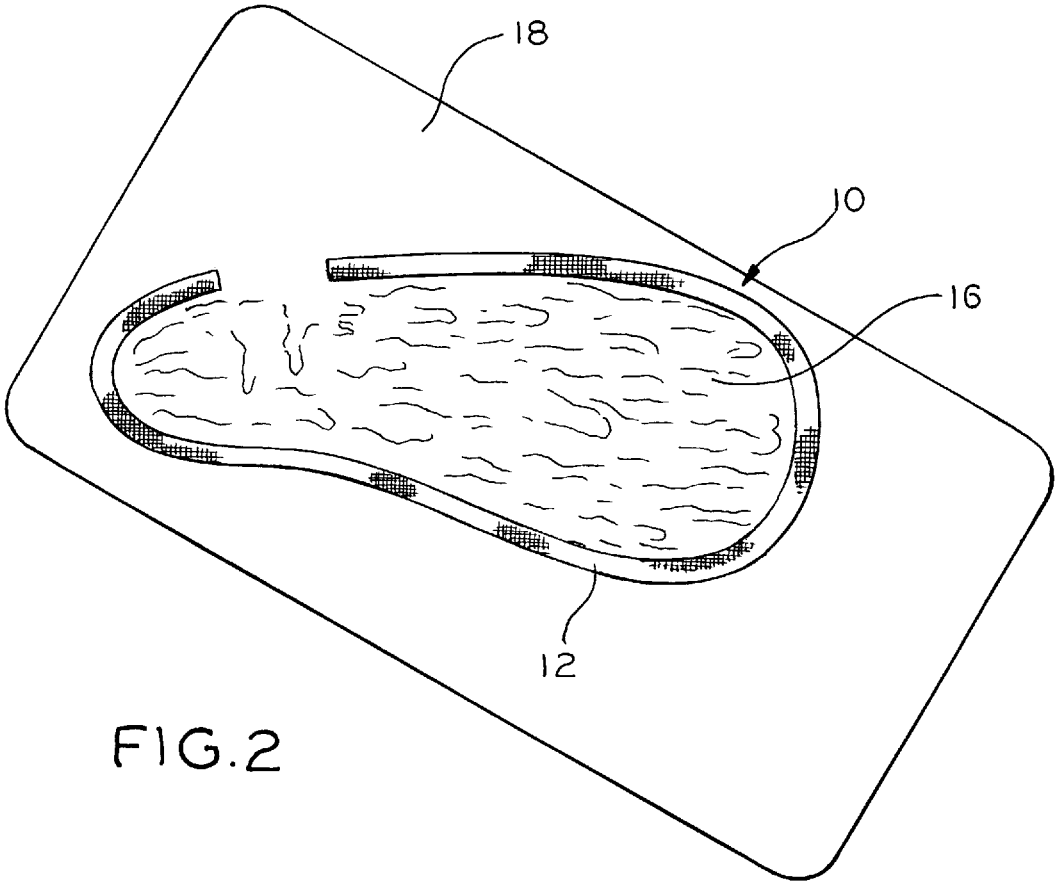
FIG. 2 is a perspective view showing the apparatus illustrated in FIG. 1 containing the spillage of a liquid on a surface.

In a preferred embodiment, the apparatus 10 is adapted to absorb and retain a spillage of a liquid 16 on a hard surface 18 (see FIG. 2). It will also be appreciated from considering both FIG. 1 and FIG. 2 that the apparatus 10 comprises a closed fabric container 12 inasmuch as opposite ends thereof may either be tied as at 20 or clamped as at 22. Advantageously, the closed fabric container 12 is formed of a cloth material for at least partially absorbing the liquid 16 therewithin.

As is suggested by FIG. 1, the filler material 14 is preferably a loose material which is entirely confined within the closed fabric container 12. The filler material 14 is thus able to at least partially absorb the liquid 16 from the spillage therewithin. In an advantageous application, the loose filler material 14 comprises a bindery paper dust substantially entirely filling the closed fabric container 12.

Figure 4:
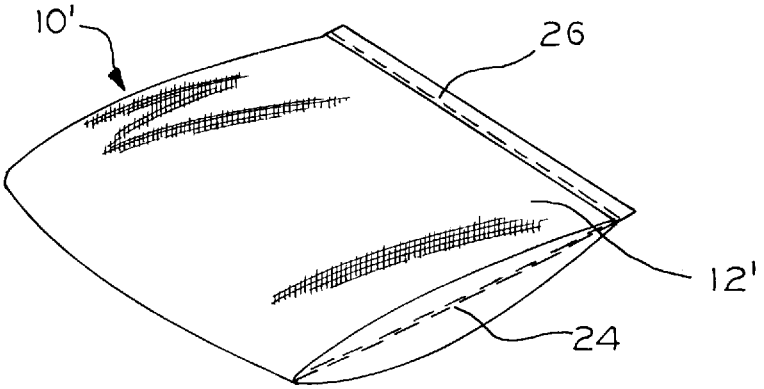
FIG. 4 is a perspective view of an alternative embodiment of apparatus for controlling and containing a liquid.

Preferably, the closed fabric container 12 has a porosity which is entirely sufficient to prevent passage of the bindery paper dust therethrough. It will also be seen that the closed fabric container 12 may advantageously be formed into a closed flexible tube with the bindery paper dust 14 therewithin, although the closed fabric container may be formed into a closed flexible bag 12 (see FIG. 4) with the fine paper dust therewithin in an alternative embodiment of the invention. In either case, the apparatus 10 or 10' is particularly well suited for use where the liquid 16 is oil and the hard surface 18 is a concrete floor in a bindery or the like.

In another respect, the present invention is directed to a method for controlling and containing a liquid 16 on a surface 18. The method comprises the steps of forming a container 12 or 12' from a fabric have a porosity sufficient to accommodate the passage of the liquid 16 therethrough, filling the container 12 or 12' with a material such as 14 which includes a paper dust for at least partially absorbing the liquid 16 therewithin, and closing the container 12 or 12' after filling the container with the material such as 14 in a manner to confine the material therewithin. When this has been done, the container 12 or 12' is placed on the surface 18 in a manner to control and contain the liquid 16 thereby.

Further aspects of the method of the present invention include forming the container 12 or 12' of a cloth material for at least partially absorbing the liquid 16 therewithin. The container 12 may be formed into a closed flexible tube by utilizing a knot 20 or a clamp 22 following which it may be placed about the liquid 16 on the hard surface 18. The container 12' may be formed into one or more closed flexible bags by utilizing seams such as 24 and 26 following which it may be placed about the liquid 16 on the hard surface 18. In either case, the material filling step includes substantially entirely filling the container 12 or 12' with a material such as 14 which includes a loose bindery paper dust.

In one particularly advantageous application, the container 12 can be seen to be draped about a piece of machinery 28. It will be appreciated that any leakage of a liquid such as oil from the machinery 28 can thereby be confined to the immediate perimeter of the machinery to protect the immediate surrounding area for personnel working nearby. As will be appreciated, the machinery 28 could be bounded by a plurality of closed flexible bags 12' in order to achieve the same result.

Figure 3:
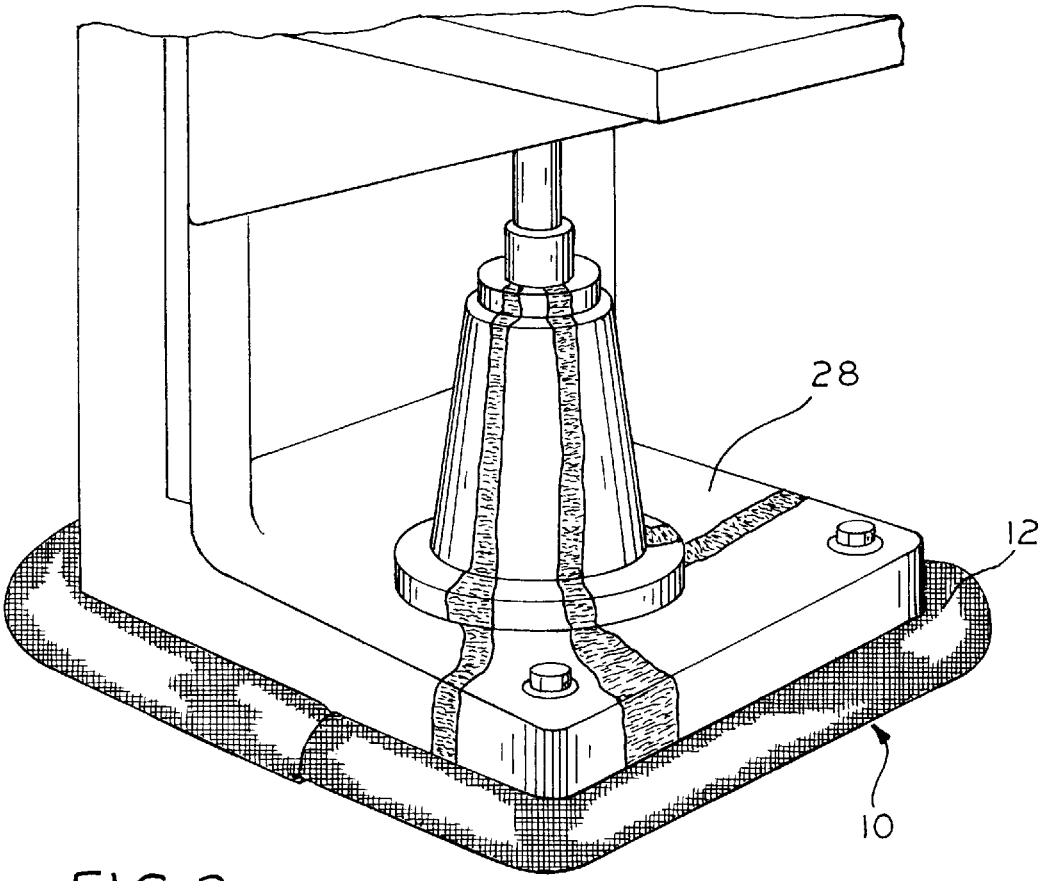
FIG. 3 is a perspective view showing the apparatus illustrated in FIG. 1 containing the spillage of a liquid from a machine.

In other words, FIG. 3 demonstrates that the containers 12 or 12' can be used as dams to restrict the flow of liquid such as 16 while partially absorbing the liquid such as 16 from any spillage from the machinery 28.

With the present invention, it is possible to control and contain a liquid on a surface by absorbing and retaining a spillage of the liquid on the surface while utilizing an otherwise useless bindery waste product.

While in the foregoing there have been set forth preferred embodiments of the invention, it will be appreciated that the details herein given may be varied by those skilled in the art without departing from the true spirit and scope of the appended claims.

We claim:

1. A method for using a heretofore known industrial waste material for the utilitarian purpose of controlling and containing a liquid on a hard surface, comprising the steps of:

accumulating the industrial waste material in the form of paper dust in a bindery for use as a loose filler material for a container;

forming a container from a fabric having a porosity sufficient for passage of said liquid therethrough;

substantially entirely filling said container with said paper dust as accumulated at said bindery;

closing said container after filling said container with said accumulated paper dust from said bindery; and placing said container on said surface after closing in order to control and contain said liquid thereby.

2. The method of claim 1 wherein said container forming step includes forming said container of a cloth material for at least partially absorbing said liquid therewithin.

3. The method of claim 2 wherein said porosity of said cloth material is also selected so as to prevent said paper dust as accumulated at said bindery from passing therethrough.

4. The method of claim 1 wherein said container forming step includes forming said container into a closed flexible tube and placing said closed flexible tube on said surface to control and contain said liquid.

5. The method of claim 1 wherein said container forming step includes forming said container into a closed flexible bag and placing said closed flexible bag on said surface to control and contain said liquid.

6. The method of claim 1 wherein said liquid is oil and said surface is a concrete floor in a bindery.

* * * * *